US008225722B2

(12) United States Patent
Graf et al.

(10) Patent No.: US 8,225,722 B2
(45) Date of Patent: Jul. 24, 2012

(54) CRASH MODULE FOR A RAIL VEHICLE

(75) Inventors: Richard Graf, Vienna (AT); Robert Nedelik, Vienna (AT); Markus Seitzberger, Vienna (AT)

(73) Assignee: Siemens AG Österreich, Vienna (AT)

( * ) Notice: Subject to any disclaimer, the term of this patent is extended or adjusted under 35 U.S.C. 154(b) by 0 days.

(21) Appl. No.: 12/677,354

(22) PCT Filed: Sep. 19, 2008

(86) PCT No.: PCT/EP2008/062531

§ 371 (c)(1), (2), (4) Date: Mar. 10, 2010

(87) PCT Pub. No.: WO2009/040309

PCT Pub. Date: Apr. 2, 2009

(65) Prior Publication Data

US 2010/0218701 A1 Sep. 2, 2010

(30) Foreign Application Priority Data

Sep. 20, 2007 (AT) ..... A 1472/2007

(51) Int. Cl.
*B61D 15/06* (2006.01)

(52) U.S. Cl. ..... 105/392.5; 213/220

(58) Field of Classification Search ..... 105/392.5; 213/220; 293/132, 134, 135–137, 150, 152
See application file for complete search history.

(56) References Cited

U.S. PATENT DOCUMENTS

| | | | | |
|---|---|---|---|---|
| 6,158,356 | A * | 12/2000 | Hachet et al. | 105/392.5 |
| 6,244,637 | B1 * | 6/2001 | Leonhardt et al. | 293/102 |
| 6,579,034 | B1 * | 6/2003 | Welch et al. | 404/6 |
| 6,845,874 | B2 * | 1/2005 | Payne et al. | 213/221 |
| 7,543,537 | B2 * | 6/2009 | Seitzberger et al. | 105/392.5 |
| 7,597,052 | B2 * | 10/2009 | Malfent et al. | 105/392.5 |
| 7,810,437 | B2 * | 10/2010 | Mattschull | 105/392.5 |
| 2004/0159263 | A1 * | 8/2004 | Yamamoto et al. | 105/392.5 |
| 2004/0251698 | A1 * | 12/2004 | Welch et al. | 293/133 |
| 2007/0261592 | A1 * | 11/2007 | Mochida et al. | 105/392.5 |
| 2008/0041268 | A1 * | 2/2008 | Seitzberger et al. | 105/392.5 |
| 2009/0000506 | A1 * | 1/2009 | Jaede | 105/392.5 |
| 2010/0064931 | A1 * | 3/2010 | Heinisch et al. | 105/392.5 |
| 2010/0218701 | A1 * | 9/2010 | Graf et al. | 105/392.5 |

FOREIGN PATENT DOCUMENTS

| | | | |
|---|---|---|---|
| DE | 19757917 | A1 | 7/1998 |
| EP | 1746007 | A2 | 1/2007 |
| GB | 2404635 | A | 2/2005 |
| JP | 2005022598 | A | 1/2005 |
| WO | WO 2004083526 | A1 * | 9/2004 |
| WO | WO 2006024059 | A2 | 3/2006 |

* cited by examiner

*Primary Examiner* — S. Joseph Morano
*Assistant Examiner* — Jason C Smith

(57) ABSTRACT

A crash module for a rail vehicle is provided. The crash module includes a crash element, a frontal impact plate and a rear connecting plate, wherein a guide element is provided between the frontal impact plate and the rear connecting plate. The guide element has the form of a plate and is oriented essentially in a longitudinal direction of the rail vehicle.

19 Claims, 7 Drawing Sheets

CRASH MODULE FOR A RAIL VEHICLE

CROSS REFERENCE TO RELATED APPLICATIONS

This application is the U.S. National Stage of International Application No. PCT/EP2003/062531 filed Sep. 19, 2008, and claims the benefit thereof. The International Application claims the benefits of Austrian Application No. A1472/2007 AT filed Sep. 20, 2007. All of the applications are incorporated by reference herein in their entirety.

FIELD OF INVENTION

The invention relates to a crash module for a rail vehicle, consisting of at least one crash element which is disposed between a front impact plate and a rear connecting plate.

BACKGROUND OF INVENTION

In the event of a collision between two rail vehicles, a large part of the collision energy occurring is advantageously absorbed by plastic deformation in crumple zones that are deformable in a defined manner in the end areas of the rail vehicles. The crumple zones can be implemented as extensive crash areas or as crash elements with specific geometry and either incorporated in the supporting structure or mounted on the front structure as freestanding crash modules. However, especially with freestanding elements it must be taken into account that, in such elements, shear forces and bending moments of the kind occurring in the event of eccentric load application can produce global buckling with reduced energy absorption and consequently 'riding up' of the collision partners.

In order to counteract these problems, guides can be provided, for example, for absorbing shear forces and bending moments. U.S. Pat. No. 6,158,356 describes such a solution in which, in the front area of a rail vehicle, a front and a rear flat ring are disposed parallel to one another and perpendicular to the direction of travel. The rings are connected on their upper side by an articulated joint so that they rotate in the event of a crash, and each have on their underside two tubular damping elements which slide into one another. The disadvantage of this solution is not only the large space requirement and complex design, but also the fact that only a reduced compression distance is available for energy dissipation. Consequently, the rail vehicle can be damaged by transmission of impact energy.

Other solutions make use of the progressive plastic buckling behavior of axially compressed crash elements for energy dissipation in collisions. However, in the case of small cross-sectional dimensions and the absence of lateral guidance, these elements react sensitively to eccentric load applications. Such solutions are therefore unsuitable for overly large offset between the collision partners, as they cannot prevent twisting of the contact surfaces and 'riding up' of the collision partners can therefore occur.

SUMMARY OF INVENTION

An object of the invention is therefore to create a device which provides a simple means of ensuring energy dissipation in crash elements by compression in the longitudinal direction of a rail vehicle even in the case of off-center load application and effectively prevents the collision partners from 'riding up' over one another.

This object is inventively achieved by a crash module of the above mentioned type by providing between the front impact plate and the rear connecting plate at least one plate-shaped guide element for the at least one crash element, said guide element being essentially oriented in the longitudinal direction of the rail vehicle. This guide element is designed such that it does not appreciably affect the deformation behavior of the crash element in the event of compression in the longitudinal direction of the rail vehicle, but if necessary significantly withstands shear forces occurring in the vertical direction and bending moments about the transverse axis of the vehicle.

By means of this guide element, the impact energy produced in the event of a collision between rail vehicles can be transmitted along the longitudinal direction of a rail vehicle to crash elements present, and 'riding up' or 'climbing' of the collision partners over one another can be prevented. This function is inventively maintained in the event of eccentric loading, e.g. if the collision partners collide with vertical offset with respect to one another. For crash elements compressed along the longitudinal direction of a rail vehicle, this is therefore an effective guiding mechanism for maintaining the functionality of the collapsing behavior in response to eccentric loading.

The invention is further characterized by a simple, inexpensive and compact design and can be easily replaced if required. As any dimensioning of the guide elements is possible, there is no reduction in the maximum compression distance of the crash elements.

With the crash module according to the invention, it is advantageous if anti-climbing devices are disposed on the front impact plate. As well as preventing twisting of the contact surfaces, this is an essential measure to prevent one vehicle front from sliding vertically off the other in the event of a collision between two rail vehicles, resulting in 'riding up'. Different types of anti-climbing protection are known, a number of horizontal ribs, for example, being used in this case.

The guide element advantageously has an essentially rectangular shape and is also disposed vertically. This arrangement enables deflection of the contact surfaces in the vertical direction to be prevented. It is also basically possible to dispose the guide element horizontally, thus enabling effective support to be provided in the transverse direction, thereby ensuring optimum energy dissipation into the crash elements in the event of collisions with horizontal offset.

The guide element can be implemented in various ways, e.g. as a solid plate or in the form of a box section. However, it is necessary for the guide element to be able to effectively absorb bending moments about the transverse axis of the vehicle and shear forces in the vertical direction (for a vertically disposed guide element—in the case of a horizontal arrangement, corresponding requirements must be fulfilled). It is therefore particularly advantageous if the guide element has a U-shaped cross-section with a top flange and a bottom flange. This structure provides the required qualities and high stability as well as being lightweight and compact and is very easy to manufacture, e.g. from a piece of sheet metal by cutting to size and folding over.

In order to best achieve the object of the invention, it is advantageous if the guide element has at least one wanted deformation zone. When a collision occurs, the guide element can deform along said wanted deformation zone and thus ensure that the impact energy is absorbed in the crash elements in the longitudinal direction of the rail vehicle. If the guide element is disposed vertically, the wanted deformation zone is more advantageously oriented essentially vertically, i.e. it is advantageously a "hinged joint" with a vertical axis of rotation. It is basically advantageous if the guide element has a plurality of wanted deformation zones, e.g. at the locations where the guide element is attached to the front impact plate and to the rear connecting plate, and also approximately in the center of the guide element.

Simpler embodiments with just a single wanted deformation zone can be implemented if the guide element is not fixedly connected to the connecting plates, but clipped into or abutting the crash module, but in any case mounted such that the ends of the guide element are movable in each case. In the event of a collision, the guide element would then deform at the wanted deformation zone in a defined manner and then behave "like a hinge" at the respective ends, so that the inventive function is provided with minimal design complexity.

The wanted deformation zone is advantageously a plastic hinge. A plastic hinge is not a joint designed as a discrete component, but a linear zone of the guide element which is characterized as far as possible by great mechanical deformability and which, when deforming, deforms plastically in the manner of a hinge. Such a plastic hinge has the advantage that it can be implemented with minimal cost/complexity yet exhibits the desired properties.

In this case the plastic hinge is, for example, a bend in the guide element at which the element begins to deform when a load is applied, as occurs in a collision. The bend here forms a plastic hinge line, the plastic hinge also having cutouts in the top flange and in the bottom flange of the guide element, said cutouts being implemented normal to the longitudinal direction of the rail vehicle. This ensures that the weak spot for the deformation is located in this area and the plastic hinge is therefore explicitly positioned in the guide element.

In another embodiment of the invention, the wanted deformation zone can be a mechanical hinge. This has the advantage that the deformation is reversible and the guide element incorporating the hinges can be re-used. After a collision, only the crash elements of the crash module would have to be renewed, but the guide elements could continue to be used. Such an embodiment is particularly advantageous if, in addition to the reversible guide element, reversible crash elements such as e.g. hydrostatic buffer elements, gas hydraulic elements, or similar, are used. This would make the entire crash module reversible and enable it to be re-used.

The wanted deformation zone is advantageously disposed on the guide element such that it subdivides the guide element into at least two areas. Depending on the design of the wanted deformation zone, said element areas are only locally separated areas which are, however, part of a unit (plastic hinge), or even areas which are also physically separated (mechanical hinge). Both variants are possible here and non-limiting in respect of the inventive function of the crash module.

As already described, it suffices for the inventive function if only one wanted deformation zone, advantageously in the center of the guide element, is implemented. However, the function can be improved if the guide element has three wanted deformation zones. Said three deformation zones enable the guide element to concertina, thereby ensuring that the impact energy of a collision is transmitted into the crash elements in the longitudinal direction of the rail vehicle.

It is generally advantageous if such a wanted deformation zone is located at the junction between the at least two areas of the guide element, one wanted deformation zone is disposed in the region of the attachment point of the guide element to the front impact plate and another wanted deformation zone is located in the region of the attachment point of the guide element to the rear connecting plate, the region of the respective attachment point extending to the point on the guide element which is a third of the total length of the guide element from the respective attachment point. The advantage of this arrangement is that, by providing three wanted deformation zones, defined deformation of the guide element is possible. The wanted deformation zones at the respective ends of the guide element are advantageously not disposed at the attachment points of the element to the front impact plate and rear connecting plate, but slightly offset therefrom. As the attachment points are potentially problematical—for example, they may be welded seams which are known to have specific properties—this offsetting enables problem-free operation to be ensured.

The crash module can be of simpler design if a wanted deformation zone is located directly at the attachment point of the guide element to the front impact plate, another wanted deformation zone is disposed directly at the attachment point of the guide element to the rear connecting plate and a further wanted deformation zone is located at the junction between the at least two element areas of the guide element.

Advantageously, at least one of the wanted deformation zones is implemented as a plastic hinge and/or at least one of the wanted deformation zones is implemented as a mechanical hinge. This means that different designs of the guide element are conceivable: on the one hand, all the wanted deformation zones are implemented as plastic hinges, which would be a variant that is particularly easy to implement. On the other hand, all the wanted deformation zones can be implemented as mechanical hinges, with combinations of different types of hinge also being possible: for example, the hinges can be implemented as plastic hinges at the attachment points of the guide element to the front impact plate and the rear connecting plate, while the deformation zone can be implemented as a mechanical hinge in the center between the element areas. All other conceivable combinations are self-evidently also possible.

The variant should of course also be mentioned once again here that only the wanted deformation zone in the center between the element areas of the guide element is a plastic hinge or a mechanical hinge—basically a dedicated articulation point—which can of course be implemented in some other way—while the end areas of the guide element are held in position by clipping, abutting, clamping or similar, are "pivotable" and thus participate in deformations of the guide element within the meaning of the invention.

In a particularly advantageous embodiment, precisely two crash elements and precisely two guide elements with U-shaped cross-section are provided, the two crash elements being disposed side by side such that there is a gap between the crash elements, and the guide elements being disposed in said gap and a guide element being disposed close to a crash element in each case and each guide element being connected to the front impact plate and the rear connecting plate and, in addition, the guide elements having a wanted deformation zone at the connection points to the front impact plate and the connecting plate and also in the center at a plastic hinge line.

As already described above, the at least one plate-shaped guide element can be rigidly connected to the front impact plate and the rear connecting plate. Such a connection can be provided in different ways, e.g. by welding or riveting.

In another embodiment, the at least one plate-shaped guide element can be disposed in the crash module such that it rests against the front impact plate and rear connecting plate with an end area facing the front impact plate and the rear connecting plate respectively and the end areas are displaceable and pivotable with respect to the front impact plate and rear connecting plate respectively. Such an arrangement can be achieved, for example, if the guide element is only placed in the crash module, e.g. abutted or clipped. The advantage is that basically the guide element only needs to have a wanted deformation zone at which it deforms in the event of a collision or other application of force, while being able to move freely and in a hinge-like manner with its end areas.

It is advantageous here if these free end areas of the guide element are attached to the front impact plate or rear connecting plate using fastening means, thereby enabling the guide element to be prevented from slipping in the event of jolting/vibration and no longer being properly in place.

BRIEF DESCRIPTION OF THE DRAWINGS

The invention will now be explained in greater detail with reference to a non-limiting exemplary embodiment illustrated in the accompanying schematic drawings in which.

DETAILED DESCRIPTION OF INVENTION

Figure 1:
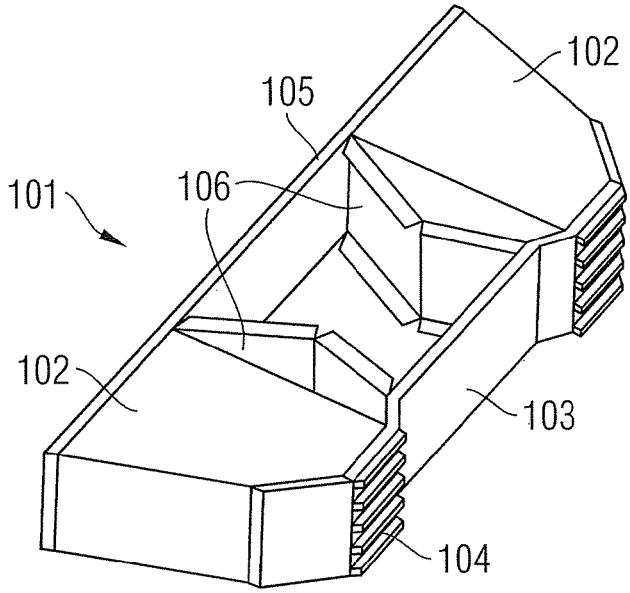
FIG. 1 shows a perspective view of a crash module according to the invention.

FIG. 1 shows a crash module 101 according to the invention, as used in rail vehicles, for example. Such a crash module 101 can be e.g. incorporated in the front part of a rail vehicle or can even be mounted in a freestanding manner at the front of a rail vehicle.

The crash module 101 consists of two crash elements 102 which are disposed side by side, said crash elements 102 consisting of plastically deformable material, e.g. aluminum or steel sections, foam material such as aluminum foam, or of reversible shock absorbing elements such as hydrostatic buffer elements, gas hydraulic elements or the like. The crash module 101 additionally comprises a front impact plate 103 with anti-climbing devices 104 and a rear connecting plate 105.

The front impact plate 103 is used to apply the load in the event of a collision. Although FIG. 1 shows only one exemplary embodiment, other embodiments are of course also conceivable without limiting the inventive function of the crash module 101. For example, an impact plate without anti-climbing devices can also be used.

The anti-climbing devices 104 are implemented as horizontal ribs which, in the event of a collision of two rail vehicles, prevent one rail vehicle from riding up onto the other causing severe damage. By way of example, in FIG. 1 five horizontal ribs are disposed in front of the crash elements 102 in each case, although other implementations are of course also possible here.

The rear connecting plate 105 is used to brace the crash module 101 in the event of a collision. The rear connecting plate 105 is usually connected to the rest of the rail vehicle.

In the event of a head-on, central collision, the impact energy is transmitted to the crash elements 102 where it is absorbed by plastic deformation. However, in the case of eccentric load application—i.e. if, for example, two rail vehicles collide with vertical offset—shear forces and bending moments will be produced. In order to handle these forces additionally occurring, guide elements 106 connecting the front impact plate 103 to the rear connecting plate 105 are disposed on the sides of the crash elements 102, said guide elements 106 being e.g. welded to the front impact plate 103 and the rear connecting plate 105. However, in a variant of the crash module, the guide elements can also be merely clipped or abutted, i.e. not bonded to the front impact plate and the rear connecting plate. In such a case, it is advantageous if the guide elements are fixed in position in some way. For example, clips can be used which hold the guide elements 106 in place, but do not impede their inventive function (see clip 114 in FIG. 4*a*).

For the sake of completeness, it should be mentioned here that the design of the rear connecting plate 105 in this embodiment is likewise only an example and one of many possible designs.

Figure 2:
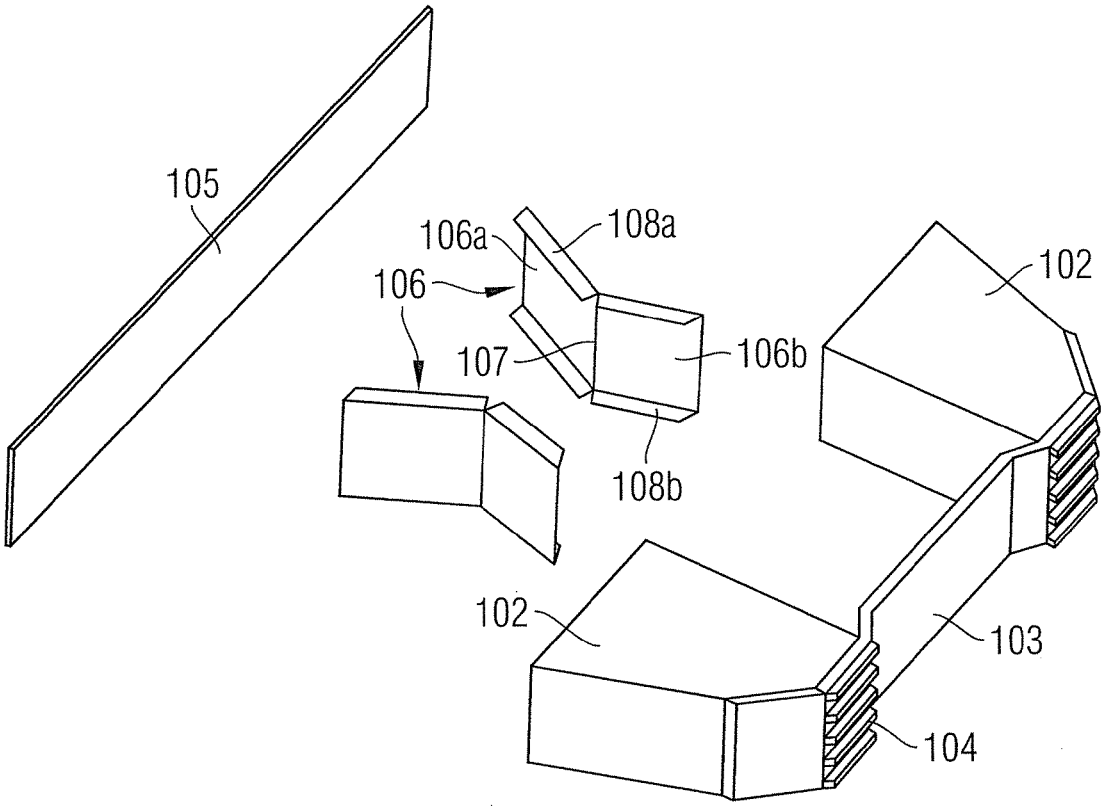
FIG. 2 shows an exploded view of the crash module from FIG. 1.

FIG. 2 is an exploded view of the crash module 101 from FIG. 1 giving a more precise picture of the individual elements of the crash module 101. Particularly noteworthy here are the guide elements 106: these are implemented in the form of additional sections having a cross-section which can absorb high bending moments about the lateral axis. Basically four different designs are possible: for example, the guide element 106 could be implemented as a box section or as a solid plate—it having to be ensured in any case, however, that the guide element 106 is capable of absorbing shear forces and bending moments. Basically, the guide element 106 is made rectangular and essentially plate-shaped and is oriented in the longitudinal direction of the rail vehicle. In order to be able to ensure that the impact energy is guided in the longitudinal direction of the rail vehicle in the event of vertical offset between the colliding vehicles, it is required that the guide element 106 be disposed vertically.

Also conceivable, however, is a variant in which the guide element is disposed horizontally, thus ensuring proper transmission of the impact energy into the crash elements in the event of collisions with horizontal offset.

In this exemplary embodiment, the guide element 106 is implemented as a U-shaped cross-section having a web and a top flange 108*a* and a bottom flange 108*b*. The guide elements 106 are attached, e.g. welded, to the front impact plate 103 and to the connecting plate 105. At these attachment points and approximately in the center, the guide element 106 has structural wanted deformation zones at which it preferably deforms when energy is applied to it, e.g. due to an impact with an obstacle.

These wanted deformation zones are implemented as cutouts in the section and as fold lines or more specifically plastic hinge lines 107. Clearly visible in FIG. 2 are the rectangular cutouts in the top flange 108*a* and in the bottom flange 108*b* of the guide element 106 and the fold along the plastic hinge line 107. From FIG. 1 it can be seen that the top flange 108*a* and bottom flange 108*b* likewise have cutouts at the connection points to the front impact plate 103 and the rear connecting plate 105. In the event of a collision, plastic hinges are created at the wanted deformation zones. Viewed from above, these plastic hinges form a triangle having a hingeable joint at each vertex and thus producing no or no appreciable constraining force if one side is shortened. Therefore, in the event of central load application, no significantly higher force is expended to crumple the crash elements 102, which thus absorb the impact energy.

In the event of non-central load application, in addition to the normal force in the longitudinal direction of the rail vehicle there are also produced bending moments and shear forces which can only be poorly absorbed by the deformable crash elements 102. There is therefore even the risk of global buckling of the crash elements 102, which means that they are unable to absorb the impact energy efficiently. The disposition of the guide elements 106 with their wanted deformation zones prevents the overall arrangement from twisting/deflecting.

Figure 3A:
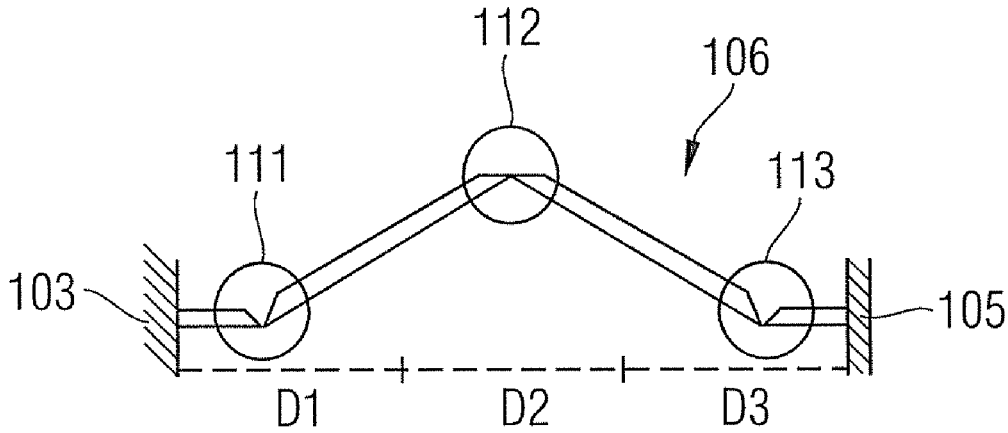
FIG. 3*a* shows a plan view of an embodiment of a guide element with three wanted deformation zones.

The wanted deformation zones can basically be disposed in different ways. FIG. 3*a* shows a plan view of a variant of a guide element 106 in which three wanted deformation zones 111, 112, 113 are provided, said deformation zones being implemented as plastic hinges which, however, of course only represents one of several possible embodiments. To facilitate understanding, the guide element is subdivided into thirds D1, D2, D3.

The first deformation zone 111 is disposed in the region of the front impact plate 103. However, it is not located directly at the attachment point of the guide element 106 to the plate, but slightly offset, in the first third D1 of the guide element 106. This avoids any difficulties which can occur at the attachment point, e.g. if the latter is implemented as a welded joint. The second deformation zone 112 is in the center of the guide element 106, i.e. in the second third D2. The third deformation zone 113 is in the region of the rear connecting plate 105, but again not directly at the attachment point, but offset in the last third D3 of the guide element.

Figure 3B:
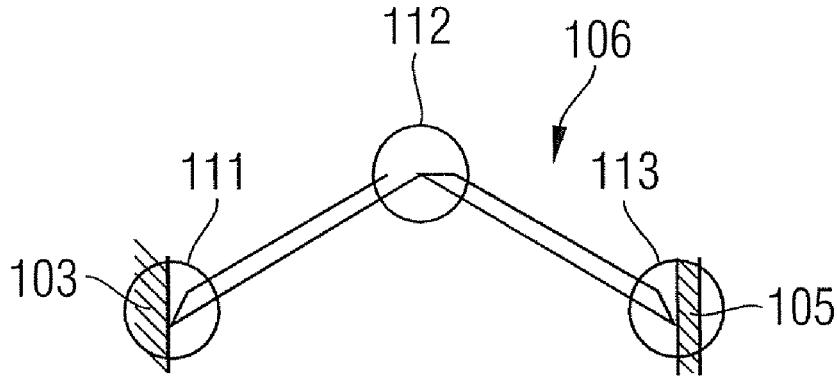
FIG. 3*b* shows a plan view of another embodiment of a guide element with three wanted deformation zones.

FIG. 3*b* shows another variant in which the first deformation zone 111 and the third deformation zone 113 are disposed directly on the front impact plate 103 and rear connecting plate 105 respectively. Basically it can also suffice if only the second deformation zone 112 is provided in the central area of the guide element 106, whereas the first 111 and the third deformation zone 113 can be dispensed with if, for example, the guide element 106 is not fixed to the front impact plate 103 and the rear connecting plate 105 but only clipped or abutted to the crash module.

Figure 4:
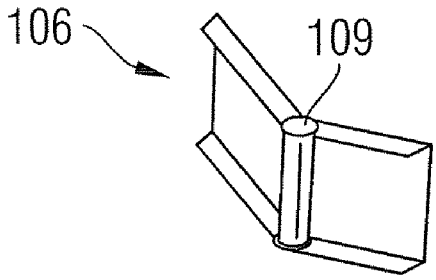
FIG. 4 shows a perspective view of a guide element with a mechanical hinge.

In the present case, the wanted deformation zones are implemented, as mentioned, as plastic hinges, i.e. as cutouts and bends in a U-shaped section. Instead of the plastic hinges it is basically also possible to provide mechanical hinges 109 permitting controlled deforming of the guide elements 106. By way of example, FIG. 4 shows a guide element 106 with a mechanical hinge 109, the representation of the joint being merely schematic and the actual embodiment of course possibly differing from this diagram.

It is basically possible to implement the respective wanted deformation zones combined with plastic hinges and mechanical hinges 109. For example, in the case illustrated in FIGS. 1 and 2, the wanted deformation zone can indeed be implemented as a plastic hinge in the center of the guide elements 106 (in FIG. 2 at the location of the plastic hinge line 107), whereas the wanted deformation zones can be implemented as mechanical hinges 109 at the front impact plate 103 and the rear connecting plate 105. The case is of course also possible where the central wanted deformation zone is implemented as a mechanical hinge 109 and the deformation zones at the plates are implemented as plastic hinges. Any other combinations, e.g. mechanical hinges 109 at the front impact plate 103 and in the center and a plastic hinge at the rear connecting plate 105, or vice versa, are also possible.

Figure 4A:
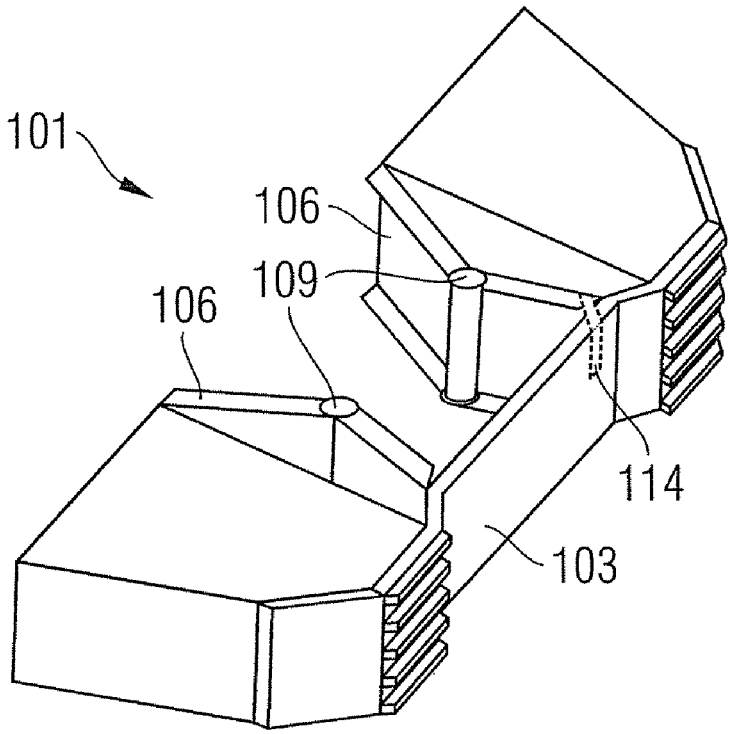
FIG. 4*a* shows a perspective view of a crash module according to the invention having guide elements with mechanical hinges.

By way of example, FIG. 4*a* shows mechanical hinges 109 combined with plastic hinges: the crash module 101 illustrated shows guide elements 106 which have mechanical hinges 109 in the center, with plastic hinges being implemented at the attachment points to the front impact plate 103 and rear connecting plate (not shown). As already described, the wanted deformation zones at the attachment points can also be dispensed with, e.g. if the guide element 106 is clipped into the crash module 101. In order to prevent the guide element 106 from being displaced in such a case, e.g. due to vibrations, it can be fixed in position using clips 114.

Figure 5:
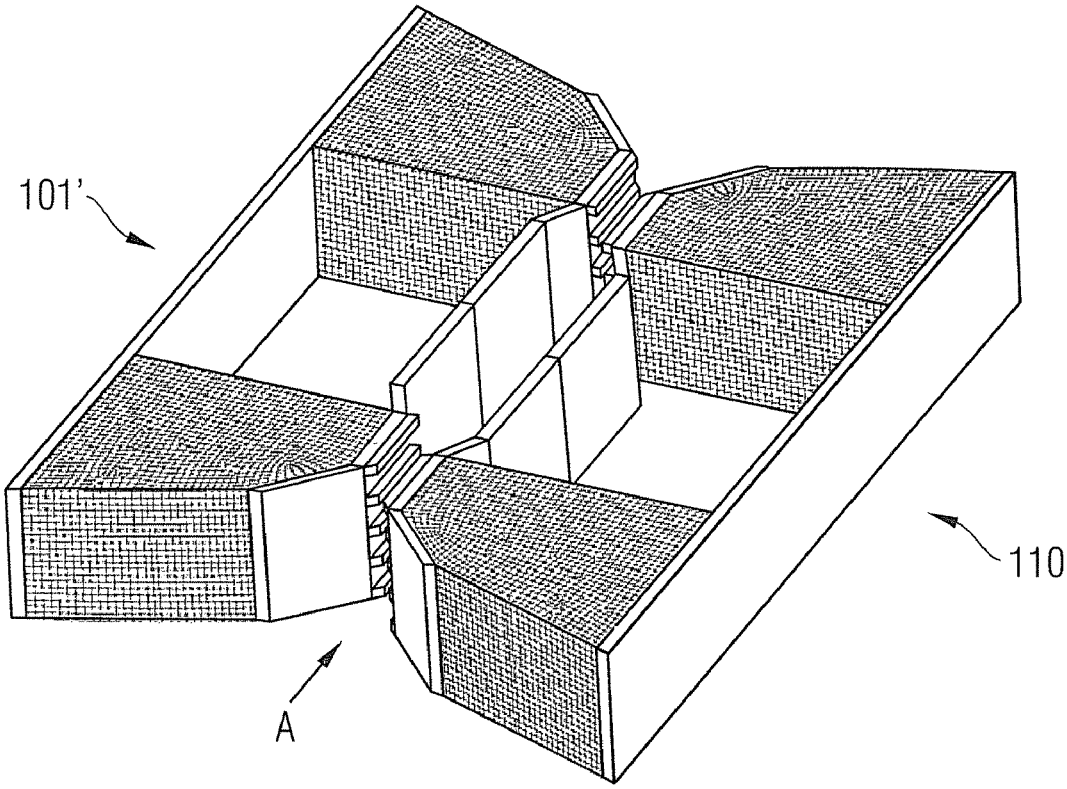
FIG. 5 shows a perspective view of the crash modules of two rail vehicles shortly before a collision with vertical offset, said crash modules having no guide elements.

FIG. 5 shows two rail vehicles shortly before the collision, said rail vehicles being represented by their crash modules 101', 110. The crash modules 101', 110 have no guide elements 106 (see FIGS. 1 and 2). The two crash modules 101', 110 collide with slight vertical offset, as can also be seen from the side view from direction A in FIG. 5*a*.

Figure 6:
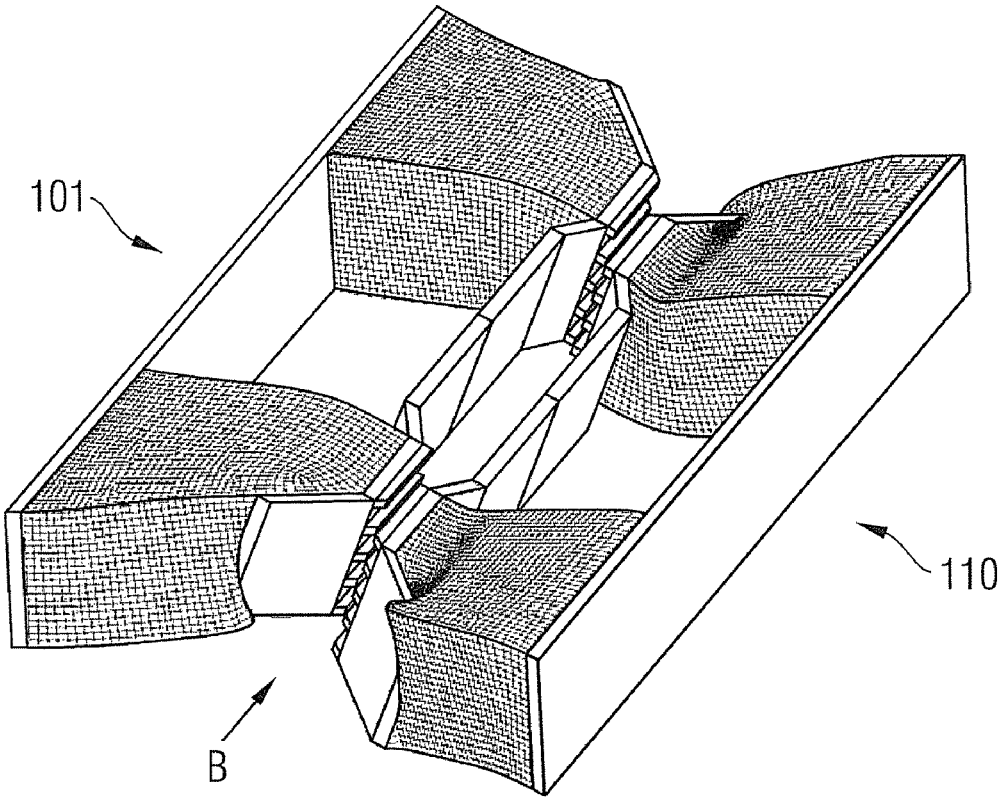
FIG. 6 shows a perspective view of the crash modules of two rail vehicles as shown in FIG. 5 following a collision with vertical offset.
Figure 6A:
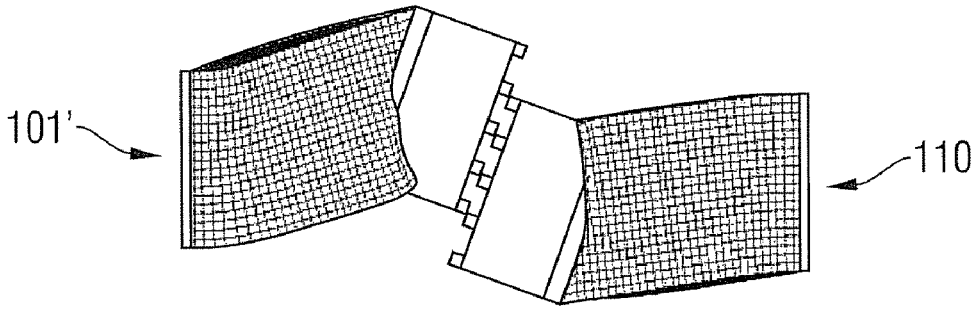
FIG. 6*a* shows a side view of the illustration in FIG. 6 from direction B.

FIG. 6 shows the crash modules 101', 110 after the collision: the off-center collision does not cause the crash elements to deform in the longitudinal direction of the rail vehicle, but to tilt—the front impact plates of the two crash modules 101', 110 twist causing one vehicle to ride up over the other. This can also be clearly seen from FIG. 6*a* which is a side view of the crash modules 101', 110 from direction B.

Figure 5A:
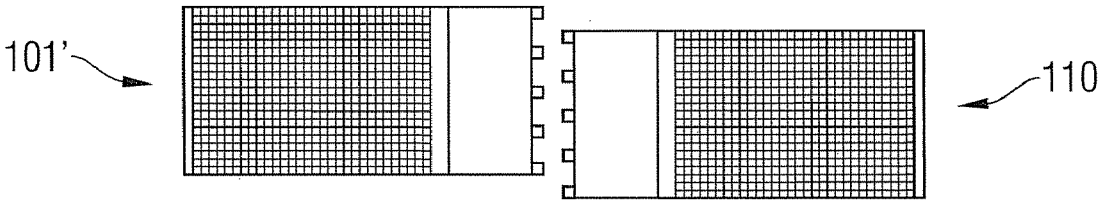
FIG. 5*a* shows a side view of the illustration in FIG. 5 from direction A.
Figure 7:
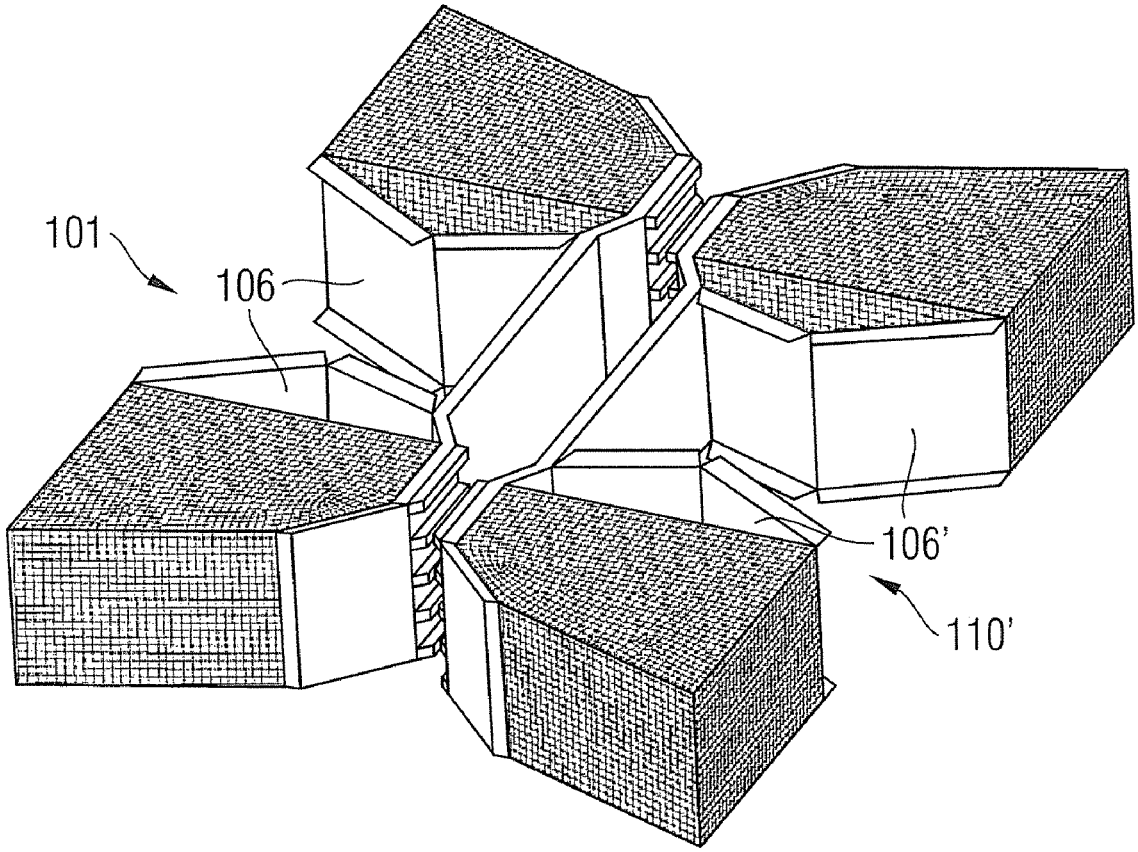
FIG. 7 shows a perspective view of the crash modules of two rail vehicles shortly before a collision with vertical offset, said crash modules having guide elements according to the invention.
Figure 8:
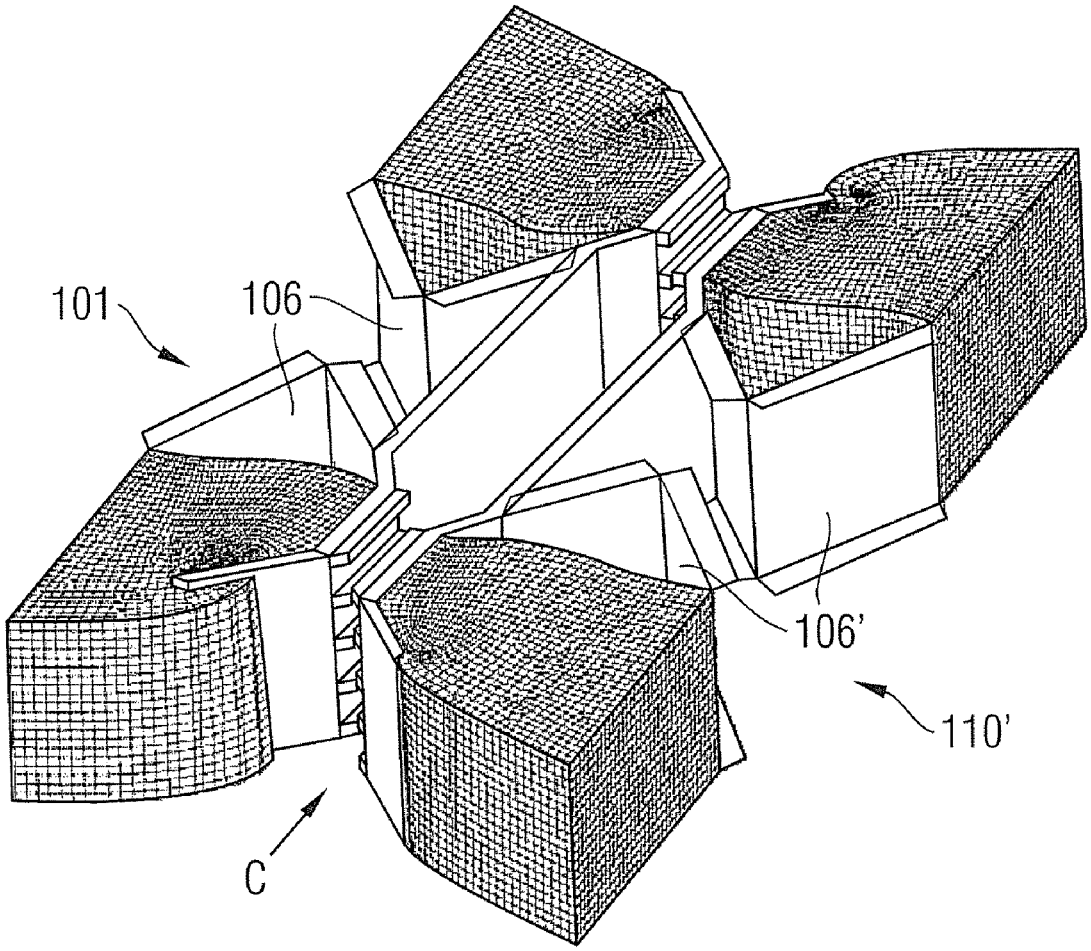
FIG. 8 shows a perspective view of the crash modules of two rail vehicles as shown in FIG. 7 following a collision with vertical offset.
Figure 8A:
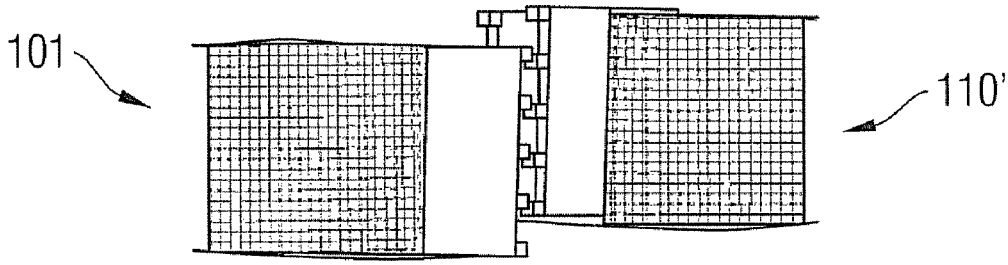
FIG. 8*a* shows a side view of the illustration in FIG. 8 from direction C.

FIGS. 7 to 8*a* show the same process, but in this case the crash modules 101, 110' are each fitted with guide elements 106, 106'. FIG. 7 shows the crash modules 101, 110' shortly before the collision, a horizontal offset again being present. The situation therefore corresponds to the situation as shown in FIG. 5*a*. To make the function of the guide elements 106, 106' more clearly visible, the rear connecting plates of the crash modules 101, 110' are not shown here.

FIG. 8 shows the crash modules 101, 110' after the collision. In contrast to the case depicted in FIG. 6, here the guide elements 106, 106' absorb a significant part of the bending moments/shear forces and thus prevent twisting of the front impact plates and the crash elements.

The guide elements 106, 106' deform at the plastic hinges in each case, said guide elements 106, 106' 'folding into' the gap between the crash elements with increasing deformation of the crash elements. Due to the absorption of the bending moments and shear forces, the impact energy of the collision is transmitted into the crash elements predominantly in the longitudinal direction of the rail vehicle by means of the guide elements 106, 106'.

FIG. 8*a* shows the side view of the case shown in FIG. 8 from direction C, from which it can be seen that no tilting of the crash elements occurs and the impact energy is optimally absorbed in the crash elements.

The invention claimed is:

1. A crash module for a rail vehicle, comprising:

a front impact plate;

a rear connecting plate;

a crash element disposed between the front impact plate and the rear connecting plate; and a plate-shaped guide element disposed between the front impact plate and the rear connecting plate, wherein the plate-shaped guide element is essentially oriented in a longitudinal direction of the rail vehicle, wherein the guide element is a solid metal sheet, and wherein the guide element has a U-shaped cross-section with a top flange and a bottom flange.

2. The crash module as claimed in claim 1, further comprising:

anti-climbing devices disposed on the front impact plate.

3. The crash module as claimed in claim 1, wherein the guide element is essentially rectangular in shape.

4. The crash module as claimed in claim 1, wherein the guide element is disposed vertically.

5. The crash module as claimed in claim 1, wherein the guide element has at least one predetermined deformation zone.

6. The crash module as claimed in claim 5, wherein the predetermined deformation zone is aligned essentially vertically.

7. The crash module as claimed in claim 5, wherein one predetermined deformation zone is a plastic hinge.

8. The crash module as claimed in claim 7, wherein the plastic hinge is implemented in the form of a plastic hinge line and cutouts in the top flange and in the bottom flange normal to the longitudinal direction of the rail vehicle.

9. The crash module as claimed in claim 5, wherein a predetermined deformation zone is a mechanical hinge.

10. The crash module as claimed in claim 5, wherein at least one predetermined deformation zone is disposed on the guide element such that the guide element is subdivided into two element areas.

11. The crash module as claimed in claim 10, wherein one predetermined deformation zone is located at the junction between the two element areas of the guide element, one predetermined deformation zone is disposed in the region of an attachment point of the guide element to the front impact plate, and one predetermined deformation zone is located in the region of the attachment point of the guide element to the rear connecting plate, the region of the respective attachment point extending to the point on the guide element that is one third of the overall length of the guide element away from the respective attachment point.

12. The crash module as claimed in claim 11, wherein at least one of the predetermined deformation zones is implemented as a plastic hinge or as a mechanical hinge.

13. The crash module as claimed in claim 10, wherein one predetermined deformation zone is located at an attachment point of the guide element to the front impact plate, one predetermined deformation zone is disposed at the attachment point of the guide element to the rear connecting plate, and one predetermined deformation zone is located at the junction between the at least two element areas of the guide element.

14. The crash module as claimed in claim 13, wherein at least one of the predetermined deformation zones is implemented as a plastic hinge or as a mechanical hinge.

15. The crash module as claimed in claim 5, wherein the guide element has three predetermined deformation zones.

16. The crash module as claimed in claim 1, comprising:

two crash elements;

two guide elements with a U-shaped cross-section, wherein the two crash elements are disposed side by side such that there is a gap between the crash elements, the guide elements are disposed in the gap with each guide element disposed close to one crash element, each guide element is connected to the front impact plate and the rear connecting plate, and the guide elements include a predetermined deformation zone on a plastic hinge line at connection points to the front impact plate, the connecting plate and in a center.

17. The crash module as claimed in claim 1, wherein the plate-shaped guide element is rigidly connected to the front impact plate and the rear connecting plate.

18. The crash module as claimed in claim 1, wherein the plate-shaped guide element is disposed in the crash module such that it rests against the front impact plate and the rear connecting plate with an end area facing the front impact plate and the rear connecting plate and the respective end areas are pushed and rotated against the front impact plate and the rear connecting plate.

19. The crash module as claimed in claim 18, wherein the respective end areas of the guide element are attached to the front impact plate and the rear connecting plate by fastening means.

* * * * *